US006802289B2

(12) United States Patent
Miyazaka et al.

(10) Patent No.: US 6,802,289 B2
(45) Date of Patent: Oct. 12, 2004

(54) VALVE TIMING CONTROL SYSTEM FOR INTERNAL COMBUSTION ENGINE

(75) Inventors: Hideyuki Miyazaka, Kanagawa (JP); Taisuke Sakane, Kanagawa (JP); Keiji Hisahara, Kanagawa (JP); Yoshinori Ichinosawa, Kanagawa (JP); Hisashi Murakami, Kanagawa (JP)

(73) Assignee: Hitachi Unisia Automotive, Ltd., Atsugi (JP)

( * ) Notice: Subject to any disclaimer, the term of this patent is extended or adjusted under 35 U.S.C. 154(b) by 0 days.

(21) Appl. No.: 10/382,864

(22) Filed: Mar. 7, 2003

(65) Prior Publication Data

US 2003/0168032 A1 Sep. 11, 2003

(30) Foreign Application Priority Data

Mar. 7, 2002 (JP) ..... 2002-061727

(51) Int. Cl.[7] ..... F01L 1/34

(52) U.S. Cl. ..... 123/90.17; 123/90.31; 123/90.37; 72/370.11; 29/34 R; 29/888.073

(58) Field of Search ..... 123/90.12, 90.15–90.17, 123/90.31, 90.37, 195 C, 195 S; 92/165 R, 166, 168, 192, 209; 464/1, 2; 72/367.1, 370.1, 370.11, 370.24; 29/34 R, 888.01, 888.49, 888.073, 282, 283.5, 522.1, 523

(56) References Cited

U.S. PATENT DOCUMENTS

| | | | | | |
|---|---|---|---|---|---|
| 5,588,404 | A | * | 12/1996 | Lichti et al. | 123/90.17 |
| 6,012,419 | A | * | 1/2000 | Iwasaki et al. | 123/90.17 |
| 6,176,256 | B1 | * | 1/2001 | Nakajima et al. | 137/505.12 |
| 6,254,356 | B1 | * | 7/2001 | Yamada et al. | 417/222.2 |
| 6,269,785 | B1 | * | 8/2001 | Adachi | 123/90.17 |
| 6,418,895 | B1 | | 7/2002 | Miyasaka et al. | 123/90.17 |
| 6,532,665 | B2 | * | 3/2003 | Parker | 29/898.051 |

* cited by examiner

*Primary Examiner*—Thomas Denion
*Assistant Examiner*—Kyle M. Riddle
(74) *Attorney, Agent, or Firm*—Foley & Lardner LLP

(57) ABSTRACT

A valve timing control system for an internal combustion engine includes a housing having and a cover member mounted thereto, a phase adjusting mechanism accommodated in the housing to hydraulically change the rotation phase of a crankshaft and a camshaft, a supply/discharge rod arranged through a through hole of the cover member and connected to the phase adjusting mechanism, a seal ring engaged with the supply/discharge rod to hermetically seal a clearance between the supply/discharge rod and the phase adjusting mechanism, a taper surface formed on the periphery of the through hole to increase the diameter of the through hole toward the outside of the housing, and a protrusion formed with the cover member in a radially inside area thereof to protrude in the axial direction of the system, wherein the through hole is formed at the protrusion.

21 Claims, 6 Drawing Sheets

VALVE TIMING CONTROL SYSTEM FOR INTERNAL COMBUSTION ENGINE

BACKGROUND OF THE INVENTION

The present invention relates to a valve timing control system for an internal combustion engine, which controls an opening and closing timing of an intake valve and/or an exhaust valve in accordance with engine operating conditions.

Typically, the valve timing control system comprises a hydraulic phase adjusting mechanism accommodated in a housing and for changing the phase of rotation of a crankshaft and a camshaft, wherein supply/discharge of hydraulic fluid to/from the phase adjusting mechanism is carried out through a supply/discharge rod arranged through a cover member of the housing.

Specifically, the housing comprises a main body having a concave space and a cover member connected thereto so as to close the concave space. A through hole is formed in the center of the cover member to receive the non-rotatable supply/discharge rod. A seal ring having a spring force acting in the diameter increasing direction is engaged with the outer peripheral surface of the supply/discharge rod to hermetically seal a clearance between a front end of the supply/discharge rod and the phase adjusting mechanism by the seal ring. A taper surface is formed on the peripheral surface of the through hole of the cover member to increase the diameter of the through hole toward the outside of the housing, so that when inserting the supply/discharge rod into the through hole, the seal ring can easily be reduced in diameter along the taper surface.

SUMMARY OF THE INVENTION

With the typical valve timing control system, however, the cover member includes a flat plate member, so that if an attempt is made to enhance the insertion-ability of the seal ring by inclining the taper surface of the through hole in the direction to approach the axis of rotation, the cover member should be increased in thickness, which raises inconveniences such as increased weight of the entire system and lowered yield of materials.

It is, therefore, an object of the present invention to provide a valve timing control system for an internal combustion engine, which allows enhancement in the insertion workability of the seal ring without occurrence of increased weight of the entire system and lowered yield of materials.

The present invention provides generally a system for controlling a valve timing in an internal combustion engine, which comprises: a housing comprising a main body having a concave space and a cover member mounted to the main body to close the space, the cover member being formed with a through hole; a phase adjusting mechanism accommodated in the housing, the phase adjusting mechanism hydraulically changing a rotation phase of a crankshaft and a camshaft; a supply and discharge rod arranged through the through hole of the cover member, the supply and discharge rod being connected to the phase adjusting mechanism, the supply and discharge rod failing to be rotatable; a seal ring externally engaged with the supply and discharge rod, the seal ring hermetically sealing a clearance between the supply and discharge rod and the phase adjusting mechanism; a taper surface formed on a periphery of the through hole of the cover member, the taper surface increasing a diameter of the through hole toward the outside of the housing; and a protrusion formed with the cover member in a radially inside area thereof, the protrusion protruding in an axial direction of the system, the through hole being formed at the protrusion.

BRIEF DESCRIPTION OF THE DRAWINGS

The other objects and features of the present invention will become apparent from the following description with reference to the accompanying drawings, wherein.

DETAILED DESCRIPTION OF THE INVENTION

Figure 1:
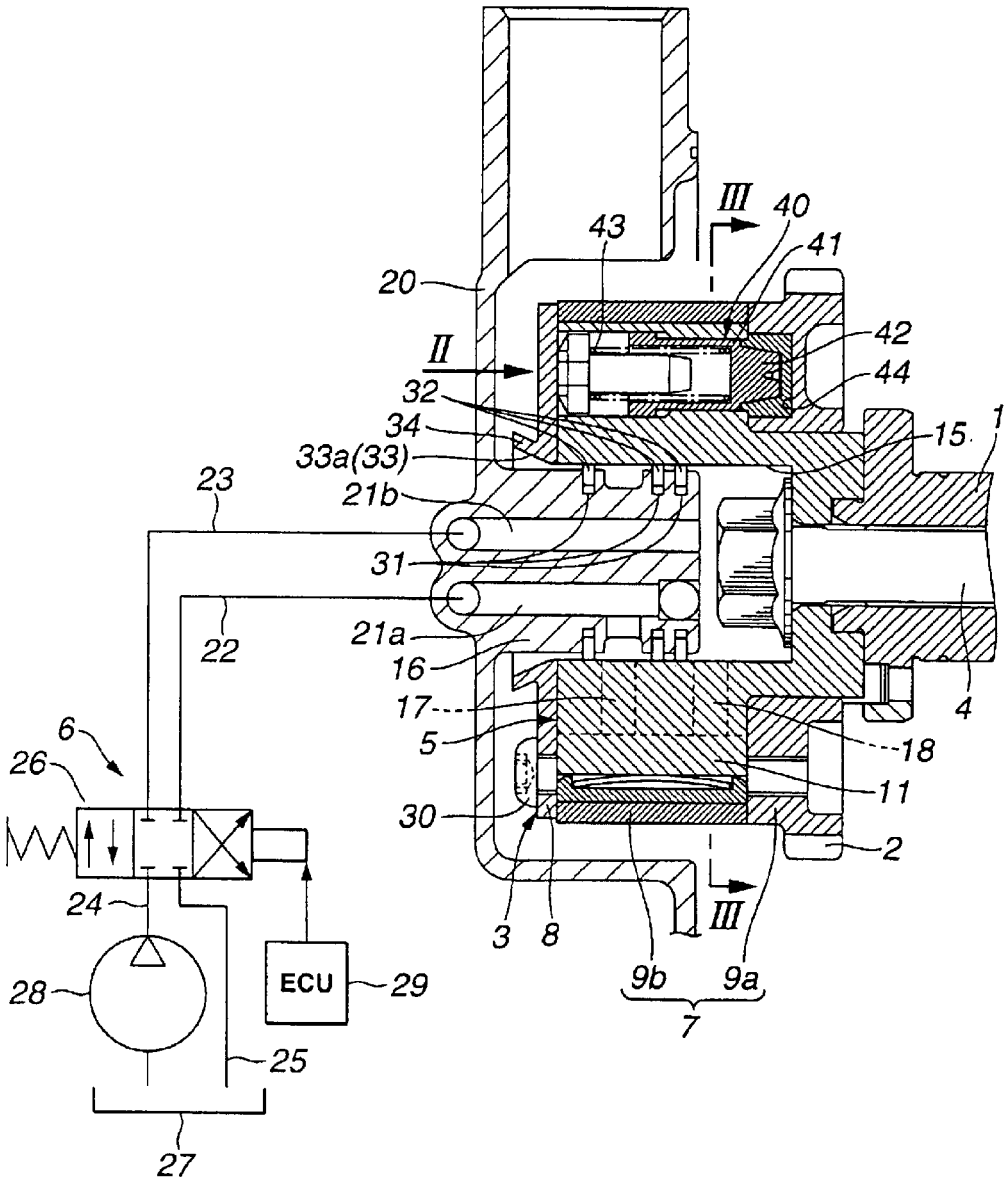
FIG. 1 is a longitudinal section taken along the line I—I in FIG. 3, showing an embodiment of a valve timing control system for an internal combustion engine according to the present invention.
Figure 2:
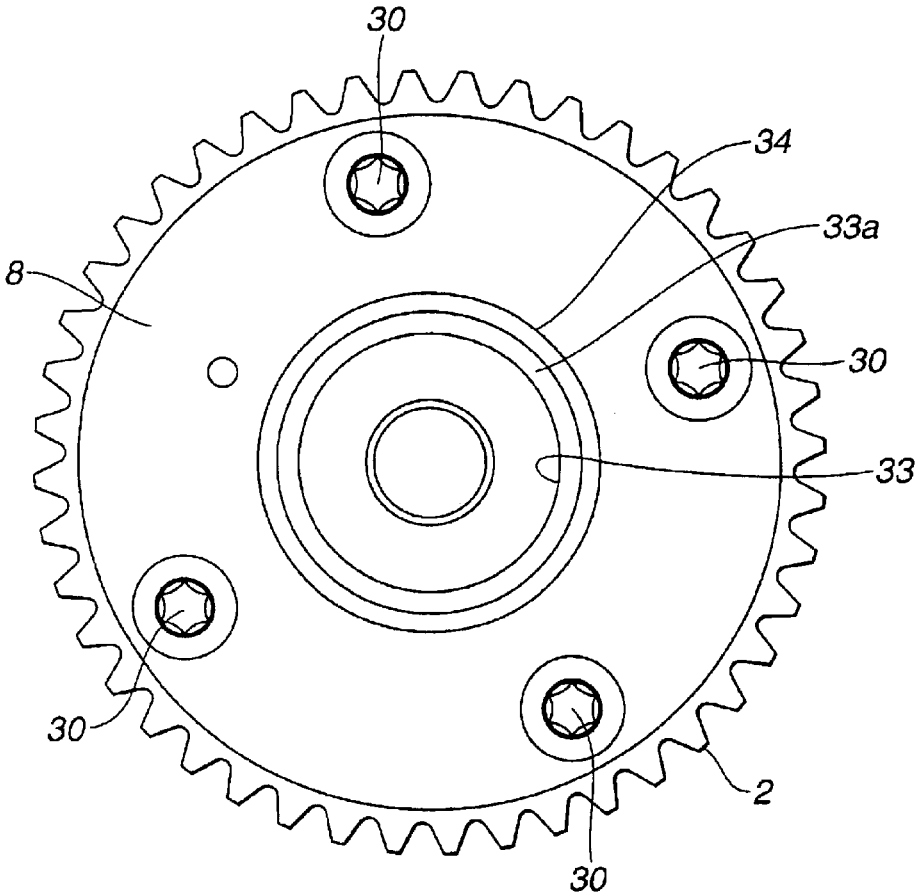
FIG. 2 is a front view of the valve timing control system as seen from arrow II in FIG. 1.

Referring to the drawings, a description is made about an embodiment of a valve timing control system for an internal combustion engine. Referring to FIG. 1, the internal combustion engine comprises a camshaft 1 rotatably supported by a cylinder head, not shown, and provided at the outer periphery of the axially center portion with a driving cam for opening and closing an intake valve or engine valve. The valve timing control system is arranged at the front end, i.e. left side in FIG. 1, of camshaft 1. In this embodiment, the valve timing control system is applied to the drive system of the intake valve. Optionally, the system is applicable to the drive system of the exhaust valve.

The valve timing control system comprises a chain sprocket 2 driven by a crankshaft of the engine through a chain, not shown, a housing or driving rotator 3 having chain sprocket 2 integrated therewith, camshaft 1 having one end to which housing 3 is mounted relatively rotatably as required, a vane rotor 5 integrally connected to the front end of camshaft 1 by a cam bolt 4 and rotatably accommodated in housing 3, and hydraulic supply/discharge means 6 for supplying/discharging hydraulic fluid to cause relative rotation of housing 3 and vane rotor 5 in accordance with the engine operating conditions. In this embodiment, camshaft 1 and vane rotor 5 constitute a driven rotator.

Figure 3:
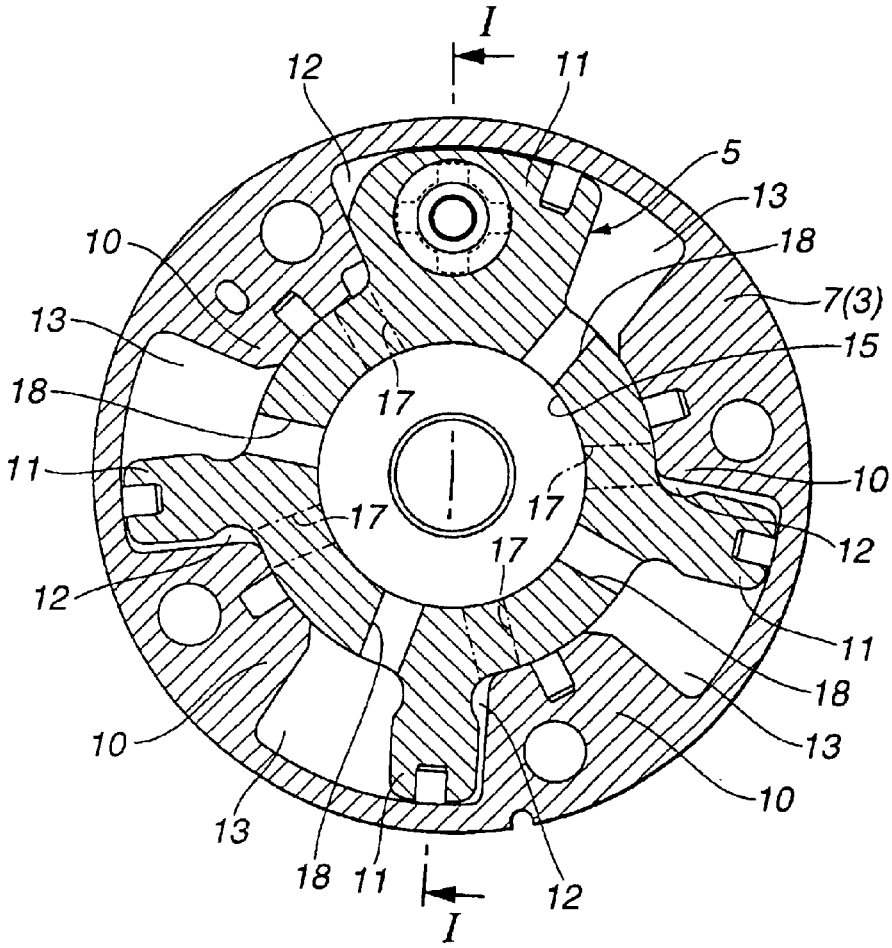
FIG. 3 is a cross section taken along the line III—III in FIG. 1.

Housing 3 comprises main body 7 formed by connecting a rear plate 9*a* having at the outer periphery chain sprocket 2 integrated therewith to a peripheral wall member 9*b*, and a cover member 8 connected to the front surface of the main body 7 so as to close the front surface of a concave space of the main body 7. Referring to FIG. 3, four partition walls 10 having trapezoidal section-are protrusively arranged on the inner peripheral surface of the housing main body 7 at intervals of roughly 90°. Cover member 8 is connected by bolts 30 to rear plate 9*a* and peripheral wall member 9*b* which constitute housing main body 7.

Vane rotor 5 comprises four vanes 11 interposed between partition walls 10, 10 adjacent in the circumferential direction of housing 3, each vane 11 defining an advance-angle chamber 12 and a lag-angle chamber 13 in a space between partition walls 10, 10. A connection hole 15 is formed in the center of the front surface of vane rotor 5, in which a supply/discharge rod 16 as will be described later is engaged. A first radial hole 17 and a second radial hole 18 have openings on the peripheral surface of connection hole 15 to communicate with advance-angle chamber 12 and lag-angle chamber 13, respectively.

Figure 6:
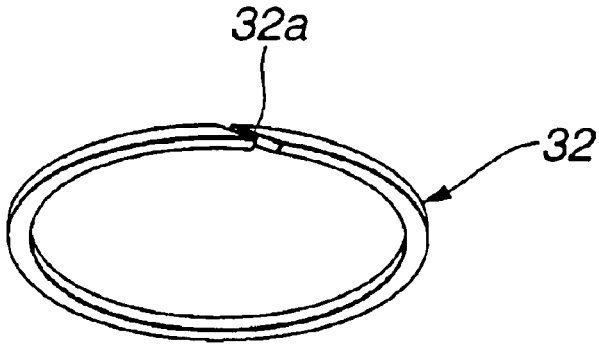
FIG. 6 is a view similar to FIG. 4, showing a seal ring.

Supply/discharge rod 16 is axially protrusively arranged on the inner surface of a VTG cover 20 mounted to the front end of the cylinder head, and has therein a pair of inner passages 21*a*. 21*b* communicating with first and second radial holes 17, 18 of vane rotor 5. supply/discharge of hydraulic fluid to/from advance-angle chamber 12 and lag-angle chamber 13 is carried out through supply/discharge rod 16. Three annular grooves 31 are formed in the outer periphery of the front end of supply/discharge rod 16, with which seal rings 32 are engaged to hermetically seal a clearance between supply/discharge rod 16 and connection hole 15 while allowing relative rotation therebetween. Referring to FIG. 6, seal ring 32 is of a resin material having excellent slide-ability and fluid-tightness, and has a slant incision 32*a* partly formed on the circumference. Seal ring 32, having a resilient force acting in the diameter increasing direction, is engaged in connection hole 15 in the radially compressed state. In this embodiment, seal ring 32 is adopted having slant incision 32*a*. Optionally, other seal ring can be adopted having non-slant incision or having no incision on condition that it has a resilient force acting on the diameter increasing direction.

As shown in FIG.1, hydraulic supply/discharge means 6 comprise two hydraulic passages: first hydraulic passage 22 for supplying/discharging hydraulic fluid to/from advance-angle chamber 12 through inner passage 21*a* of supply/discharge rod 16 and first radial hole 17 of vane rotor 5 and second hydraulic passage 23 for supplying/discharging hydraulic fluid to/from lag-angle chamber 13 through inner passage 21*b* of supply/discharge rod 16 and second radial hole 18 of vane rotor 5. A supply passage 24 and a drain passage 25 are connected to hydraulic passages 22, 23, respectively, through a solenoid-controlled selector valve 26 for switching between the passages. Referring to FIG. 1, reference numeral 27 designates an oil pan arranged on the bottom of the engine, 28 designates an oil pump, and 29 designates an electronic control unit (ECU) for controlling selector valve 26.

In this embodiment, the phase adjusting mechanism comprises vane rotor 5, advance-angle and lag-angle chambers 12, 13, and hydraulic supply/discharge means 6.

Figure 4:
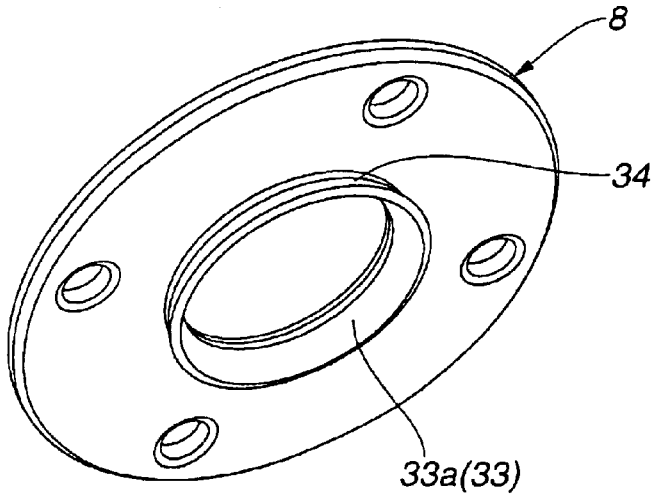
FIG. 4 is a perspective view showing a cover member.
Figure 5:
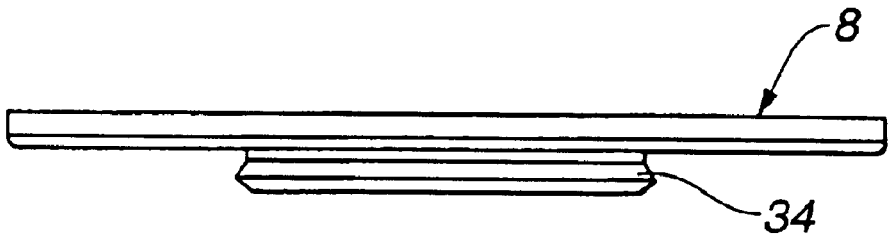
FIG. 5 is a side view showing the cover member.

Referring to FIG. 4, cover member 8 of housing 3 has in the axial center portion a through hole 33 for receiving supply/discharge rod 16. Referring also to FIG. 5, through hole 33 is formed at a protrusion 34 arranged on cover member 8 to protrude axially outward of housing 3. As shown in FIG. 1, a taper surface 33*a* is formed on the peripheral surface of through hole 33 to increase the diameter of through hole 33 toward the outside of housing 3. When inserting supply/discharge rod 16 into connection hole 33 of vane rotor 5, taper surface 33*a* serves as a guide for reducing the diameter of seal ring 32. Taper surface 33*a* may be formed either axially partly or entirely in the area of through hole 33. In this embodiment, taper surface 33*a* is only partly formed at the front end of protrusion 34 due to working as will be described later.

In this embodiment, cover member 8 in its entirety, including protrusion 34, is obtained by press forming.

Figure 7A:
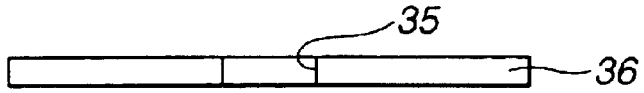
FIGS. 7A–7E are schematic sectional views explaining a method of manufacturing the cover member.
Figure 7B:
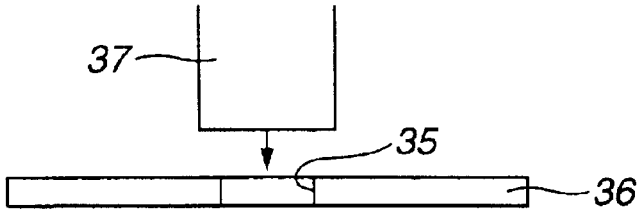
Figure 7C:
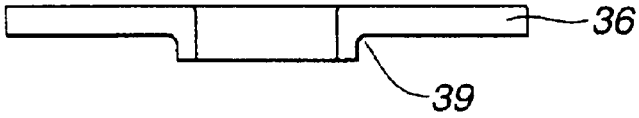

Referring to FIGS. 7A–7E, a method of manufacturing cover member 8 is described. Referring to FIG. 7A, a disk-like plate material 36 is provided having a hole 35 previously formed in the position corresponding to through hole 33 and a bolt hole, not shown. Referring to FIG. 7B, using a first cylindrical punch 37, first press forming is applied to an edge of hole 35 of plate material 36. First press forming is to expand the edge of hole 35 axially cylindrically as shown in FIG. 7C.

Figure 7D:
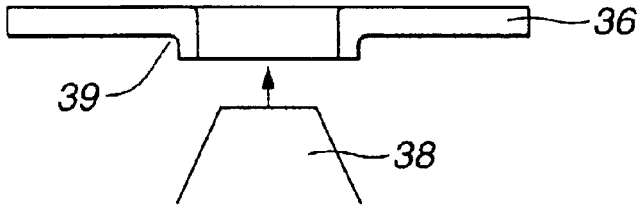

Then, referring to FIG. 7D, using a second taper punch 38, second press forming is applied to plate material 36 which has been subjected to first press forming. Second press forming is to extend like a taper a cylindrical wall 39 of plate material 36 in its entirety in conformity with second punch 38 by inserting second punch 38 into the front end of cylindrical wall 39.

Figure 7E:
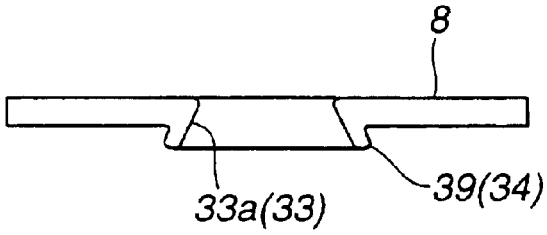

Referring to FIG. 7E, cover member 8 shaped in such a way comprises protrusion 34 formed by cylindrical wall 39 extended like a taper and through hole 33 with taper surface 33*a* formed on the inner peripheral surface of cylindrical wall 39.

Although cover member 8 can be obtained by casting or cutting, press forming allows easy shaping of cover member 8 without relying upon a high-priced mold or complicated cutting work, resulting in a great reduction in manufacturing cost.

Referring to FIG. 1, a lock mechanism 40 is arranged to restrict relative rotation of housing 3 and vane rotor 5 at starting of the engine. Lock mechanism 40 comprises a pin hole 41 axially formed in one vane 11 of vane rotor 5, a lock pin 42 slidably accommodated in pin hole 41, a spring or biasing means 43 accommodated, together with lock pin 42, in pin hole 41 and for biasing lock pin 42 toward rear plate 9*a* of housing 3, i.e. the bottom of housing main body 7, a lock hole 44 formed in the inner surface of rear plate 9*a* and for receiving the front end of lock pin 42 when vane rotor 5 is in the most lag-angle position, and a hydraulic passage, not shown, for making the lock releasing hydraulic pressure act on lock pin 42.

When the supplied hydraulic pressure is greater than a set pressure as during the ordinary engine operation, engagement of lock mechanism 40 in lock hole 44 is released by that hydraulic pressure. On the other hand, when the supplied hydraulic pressure is smaller than set pressure as at stopping or starting of the engine, and that vane rotor 5 is returned to the most lag-angle position, lock pin 42 is engaged in lock hole 44, thereby locking relative rotation of vane rotor 5 and housing 3.

Next, operation of this embodiment is described. At starting of the engine, lock mechanism 40 mechanically locks vane rotor 5 and housing 3 with vane rotor 5 being rotated to the most lag-angle side with respect to housing 3, so that torque of the crankshaft input to chain sprocket 2 is transmitted to camshaft 1 as it is. Therefore, camshaft 1 opens and closes the intake valve at a lag-angle timing.

In this state, when, after starting of the engine, operation of selector valve 26 causes communication between supply passage 24 and advance-angle chamber 12 and between drain passage 25 and lag-angle chamber 13, high-pressure hydraulic fluid is introduced into advance-angle chamber 12, and locking of lock mechanism 40 is released by that hydraulic pressure. With this, vane rotor 5 is rotated to the advance-angle side with respect to housing 3 under the hydraulic pressure within advance-angle chamber 12, so that camshaft 1 opens and closes the intake valve at an advance-angle timing.

On the other hand, in this state, when operation of selector valve 26 causes communication between supply passage 24 and lag-angle chamber 13 and between drain passage 25 and advance-angle chamber 12, vane rotor 5 is rotated to the lag-angle side with respect to housing 3 under the hydraulic pressure within lag-angle chamber 13, so that camshaft 1 opens and closes the intake valve at a lag-angle timing.

In this embodiment, since protrusion 34 is arranged in a radially inside area of cover member 8 of housing 3, and through hole 33 is formed at protrusion 34, sufficiently great axial length of through hole 33 can be secured with the thickness of cover member 8 in its entirety held small. In this embodiment, therefore, the angle of inclination of taper surface 33*a* of through hole 33 can be increased in the direction of the axis of rotation without raising inconveniences such as increased weight of cover member 8 and thus the entire system and lowered yield of materials, resulting in enhancement in the insertion workability of seal ring 32 during assembling. Moreover, as described above, the thickness of cover member 8 can be reduced sufficiently without sacrificing the insertion workability of seal ring 32, having the advantage of easy press working itself during manufacturing.

Further, protrusion 34 integrated with cover member in the radially inside area serves as an annular reinforcing rib for reinforcing an inner peripheral edge of cover member 8, so that even if the thickness of cover member 8 is reduced as a whole, cover member 8 is free from deformation, allowing prevention of interference of cover member 8 with vane rotor 5 due to deformation. Particularly, with the type of system wherein cover member 8 is connected to housing main body 7 by bolts 30 as in the embodiment, cover member 8, particularly, in the radially inside area facing the concave space of housing main body 7 is apt to be deformed by tightening of bolts 30. In this embodiment, such deformation can largely be reduced by the reinforcing function of protrusion 34.

Furthermore, with the type of system, since the head of bolts 30 for connecting cover member 8 to housing main body 7 is located on the front surface of cover member 8, VTC cover 20 should be disposed largely distant from the engine main body so as to prevent interference of the head of bolts 30 with the inner surface of VTC cover 20. In this embodiment, since the thickness of cover member 8 is reduced as a whole with protrusion 34 arranged at the inner peripheral edge of cover member 8, the head of bolts 30 can be located in the position displaced backward to the engine main body, obtaining VTC cover 20 approaching the engine main body. Therefore, in this embodiment, a further reduction can be achieved in the overall axial length of the engine, including VTC cover 20.

Further, in this embodiment, lock hole 44 of lock mechanism 40 is not arranged in cover member 8, but in housing main body 7 on the bottom, i.e. rear plate 9*a,* having the advantage of a further reduction in the thickness of cover member 8. Specifically, since lock hole 44 for receiving the front end of cover member 8 needs a certain depth, a member having lock hole 44 should be increased in thickness inevitably. In this embodiment, since lock hole 44 is arranged in the bottom of housing main body 7, the thickness of cover member 8 can be reduced sufficiently without being subject to constraints of the depth of lock hole 44.

Figure 8:
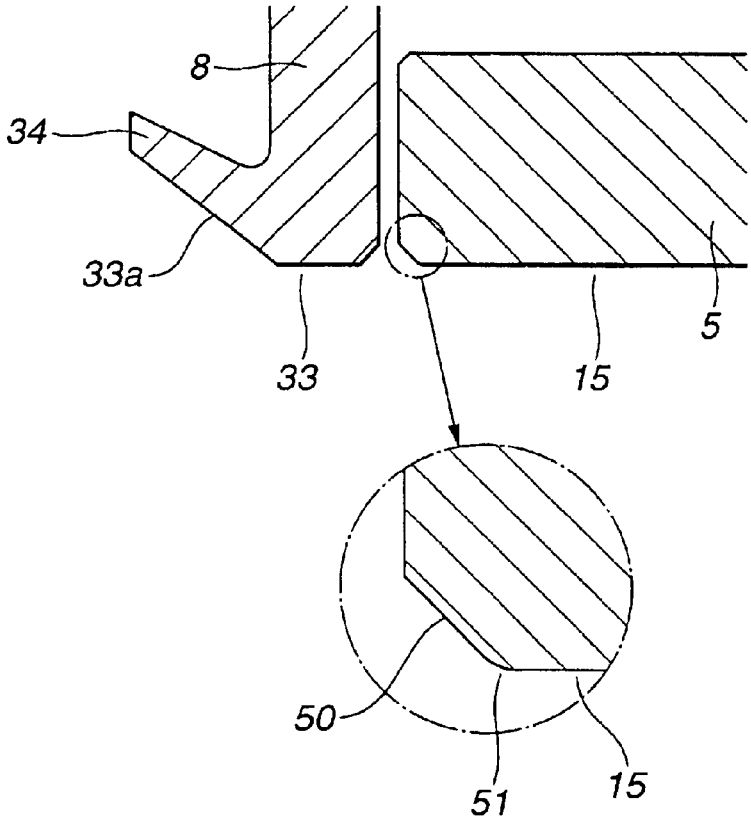
FIG. 8 is a fragmentary section showing a variation of the embodiment.

Referring to FIG. 8, there is shown a variation of the embodiment wherein an edge of connection hole 15 of vane rotor 5 is removed to provide a cut corner 50, then cut corner 50 in the obtuse-angle area close to connection hole 15 is chamfered to form a chamfered portion 51 having circular section. In this variation, an inconvenience can surely be prevented that seal ring 32 makes contact with the edge of connection hole 15 during assembling of seal ring 32, allowing further enhancement in the assembling workability of seal ring 32.

Having described the present invention with regard to the preferred embodiment, it is noted that the present invention is not limited thereto, and various changes and modifications can be made without departing from the scope of the present invention. By way of example, in the embodiment, the phase adjusting mechanism is constructed such that the hydraulic pressure is applied-to vane 11 of vane rotor 5 to cause relative rotation of the driving rotator and the driven rotator. Optionally, the phase adjusting mechanism may be constructed such that using a helical gear and the like, displacement of a hydraulically operated piston is converted to relative rotation of the driving rotator and the driven rotator. Moreover, the taper surface 33*a* may be curved as viewed in the section along the axial direction.

What is claimed is:

1. A system for controlling a valve timing in an internal combustion engine, comprising:

a housing comprising a main body having a concave space and a cover member mounted to the main body to close the space, the cover member being formed with a through hole;

a phase adjusting mechanism accommodated in the housing, the phase adjusting mechanism hydraulically changing a rotation phase of a crankshaft and a camshaft;

a supply and discharge rod arranged through the through hole of the cover member, the supply and discharge rod being connected to the phase adjusting mechanism, the supply and discharge rod failing to be rotatable;

a seal ring externally engaged with the supply and discharge rod, the seal ring hermetically sealing a clearance between the supply and discharge rod and the phase adjusting mechanism; and a protrusion formed with the cover member, the protrusion having the through hole formed therethrough, the protrusion protruding from an inner periphery of the through hole in an axial direction of the system, the protrusion having inner and outer peripheries extending to increase a diameter of the through hole toward the outside of the housing.

2. The system as claimed in claim 1, wherein the main body and the cover member of the housing are connected through bolts.

3. The system as claimed in claim 2, wherein each bolt has a head disposed on a front surface of the cover member.

4. The system as claimed in claim 1, wherein the housing is arranged to be rotatable together with at least one rotator of the crankshaft and the camshaft.

5. The system as claimed in claim 4, wherein the phase adjusting mechanism comprises a vane rotor arranged to be rotatable together with another rotator of the crankshaft and the camshaft, advance-angle and lag-angle chambers arranged on both sides of a vane of the vane rotor, and a hydraulic supply and discharge device communicating with the advance-angle and lag-angle chambers and selectively supplying and discharging a hydraulic pressure to and from the advance-angle and lag-angle chambers.

6. The system as claimed in claim 1, wherein the supply and discharge rod is axially protrusively arranged on an inner surface of a VTC cover mounted to a front end of a cylinder head.

7. The system as claimed in claim 1, wherein the seal ring has a resilient force acting in a direction of increasing diameter thereof.

8. The system as claimed in claim 1, wherein the seal ring is of a resin material and has a slant incision partly formed on the circumference.

9. The system as claimed in claim 1, wherein the taper surface is curved as viewed in a section along the axial direction of the system.

10. The system as claimed in claim 1, wherein the protrusion is tapered from head to base by press forming.

11. The system as claimed in claim 5, further comprising a lock pin which is engaged, when a supplied hydraulic pressure is smaller than a predetermined pressure, with the housing and the vane rotor so as to lock relative rotation of the two.

12. The system as claimed in claim 11, wherein a lock hole is formed in a bottom of the main body of the housing, the lock pin having an end detachably engaged with the lock hole.

13. The system as claimed in claim 5, wherein the vane rotor has in the center of a front surface a connection hole in which the supply and discharge rod is engaged, the connection hole having an edge removed to provide a cut corner.

14. The system as claimed in claim 13, wherein the cut corner in an obtuse-angle area close to the connection hole is chamfered to form a chamfered portion having a circular section.

15. The system as claimed in claim 1, wherein the protrusion is smaller in thickness than the cover member.

16. The system as claimed in claim 1, wherein the protrusion has a substantially uniform thickness.

17. The system as claimed in claim 1, wherein the cover member is substantially flat, and the protrusion comprises a ring member extending from a front facing of the cover member.

18. An internal combustion engine, comprising:

a crankshaft;

a camshaft;

a housing comprising a main body having a concave space and a cover member mounted to the main body to close the space, the cover member being formed with a through hole;

a phase adjusting mechanism accommodated in the housing, the phase adjusting mechanism hydraulically changing a rotation phase of the crankshaft and the camshaft;

a supply and discharge rod arranged through the through hole of the cover member, the supply and discharge rod being connected to the phase adjusting mechanism, the supply and discharge rod failing to be rotatable;

a seal ring externally engaged with the supply and discharge rod, the seal ring hermetically sealing a clearance between the supply and discharge rod and the phase adjusting mechanism; and a protrusion formed with the cover member, the protrusion having the through hole formed therethrough, the protrusion protruding from an inner periphery of the through hole in an axial direction of the system, the protrusion having inner and outer peripheries extending to increase a diameter of the through hole toward the outside of the housing.

19. The internal combustion engine as claimed in claim 18, wherein the cover member is substantially flat, and the protrusion comprises a ring member extending from a front facing of the cover member.

20. A system for controlling a valve timing in an internal combustion engine, comprising:

a housing comprising a main body having a concave space and a cover member mounted to the main body to close the space, the cover member being formed with a through hole;

a phase adjusting mechanism accommodated in the housing, the phase adjusting mechanism hydraulically changing a rotation phase of a crankshaft and a camshaft;

a supply and discharge rod arranged through the through hole of the cover member, the supply and discharge rod being connected to the phase adjusting mechanism, the supply and discharge rod failing to be rotatable;

a seal ring externally engaged with the supply and discharge rod, the seal ring hermetically sealing a clearance between the supply and discharge rod and the phase adjusting mechanism;

a taper surface formed on a periphery of the through hole of the cover member, the taper surface increasing a diameter of the through hole toward the outside of the housing, the taper surface being curved as viewed in a section along the axial direction of the system; and a protrusion formed with the cover member in a radially inside area thereof, the protrusion protruding in an axial direction of the system, the through hole being formed at the protrusion.

21. A method of manufacturing a cover member for use in a system for controlling a valve timing in an internal combustion engine, the method comprising:

preparing a disk-like plate material having a hole previously formed in a position corresponding to the through hole of the cover member;

applying a first press forming to an edge of the hole of the plate material using a first cylindrical punch, the first press forming expanding the edge of the hole axially cylindrically; and applying a second press forming to the plate material using a second taper punch, the second press forming extending like a taper a cylindrical wall of the plate material in its entirety in conformity with the second punch by inserting the second punch into an end of the cylindrical wall, whereby a taper surface is formed on a periphery of the through hole of the cover member, the taper surface increasing a diameter of the through hole toward the outside of the housing, the protrusion is formed with the cover member in a radially inside area thereof, the protrusion protruding in an axial direction of the system, and the through hole is formed at the protrusion.

* * * * *